US006102765A

United States Patent [19]

Forti et al.

[11] Patent Number: 6,102,765

[45] **Date of Patent: *Aug. 15, 2000**

[54] TOY GLIDER

[76] Inventors: William B. Forti; William Mark Forti, both of 112 N. Harvard #229, Claremont, Calif. 91711

[ * ] Notice: This patent issued on a continued prosecution application filed under 37 CFR 1.53(d), and is subject to the twenty year patent term provisions of 35 U.S.C. 154(a)(2).

[21] Appl. No.: 09/133,811

[22] Filed: Aug. 13, 1998

[51] Int. Cl.[7] ..... A63H 27/00; A63H 27/14

[52] U.S. Cl. ..... 446/62; 446/64; 446/68

[58] Field of Search ..... 446/62, 63, 64, 446/66, 68, 67, 65, 61, 49, 247

[56] References Cited

U.S. PATENT DOCUMENTS

| | | | |
|---|---|---|---|
| 2,039,597 | 5/1936 | Juhlin | 446/49 |
| 3,839,818 | 10/1974 | Heggedal | 446/62 |
| 3,943,657 | 3/1976 | Leckie | 446/62 |
| 4,759,736 | 7/1988 | Carlson . | |
| 4,836,817 | 6/1989 | Corbin . | |
| 4,863,412 | 9/1989 | Mihalinec . | |
| 4,863,413 | 9/1989 | Mihalinec . | |
| 4,915,664 | 4/1990 | Bakker . | |
| 5,078,639 | 1/1992 | Kippon | 446/61 |
| 5,299,966 | 4/1994 | Rose, III . | |
| 5,423,706 | 6/1995 | Chase . | |
| 5,725,410 | 3/1998 | Robinson et al. | 446/62 |

FOREIGN PATENT DOCUMENTS

| | | | |
|---|---|---|---|
| 741474 | 2/1933 | France | 446/65 |

*Primary Examiner*—D. Neal Muir
*Attorney, Agent, or Firm*—Fish & Associates; Robert D. Fish

[57] ABSTRACT

Improved toy glider having folding wings and incorporating improved release mechanisms which increase the initial height achievable by the glider by preventing early transition of the folding wings from a launch configuration to a glide configuration.

The improved glider may advantageously include a long ribbon-like tail wrapped around the glider to prevent biased wings from transitioning from a launch to a glide configuration. When the glider changes attitude in a manner indicating a change from an upward to a downward flight path, a weight is released from a support and the released weight unwraps the tail. Once the tail is unwrapped, the wings transition from a launch configuration to a glide configuration.

16 Claims, 2 Drawing Sheets

FIG. 1
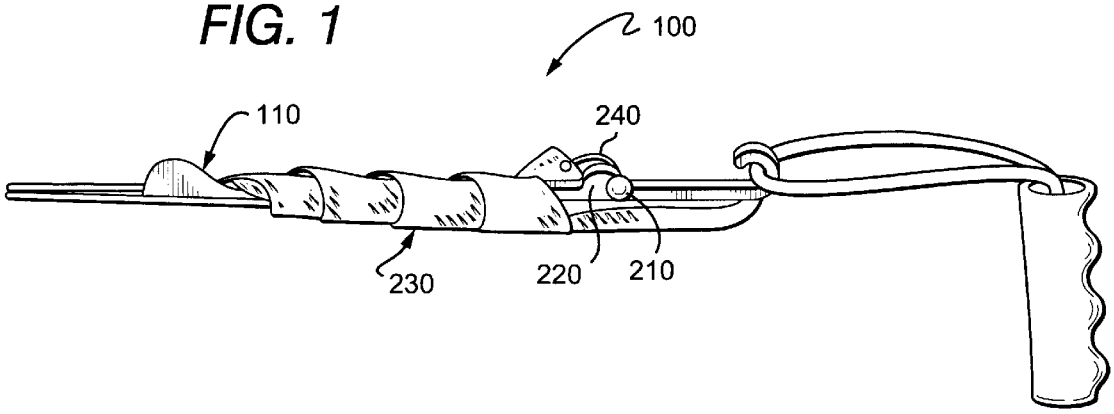
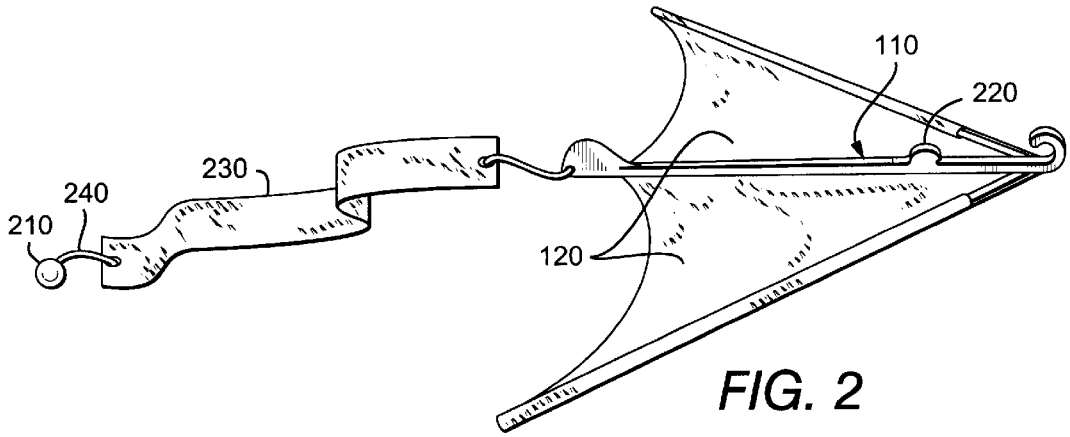
FIG. 2
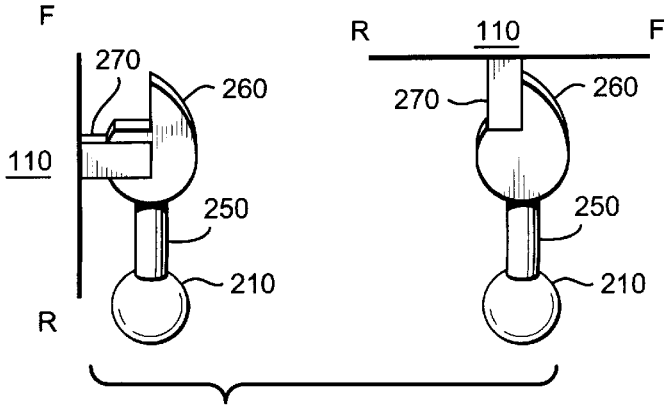
FIG. 5

FIG. 3
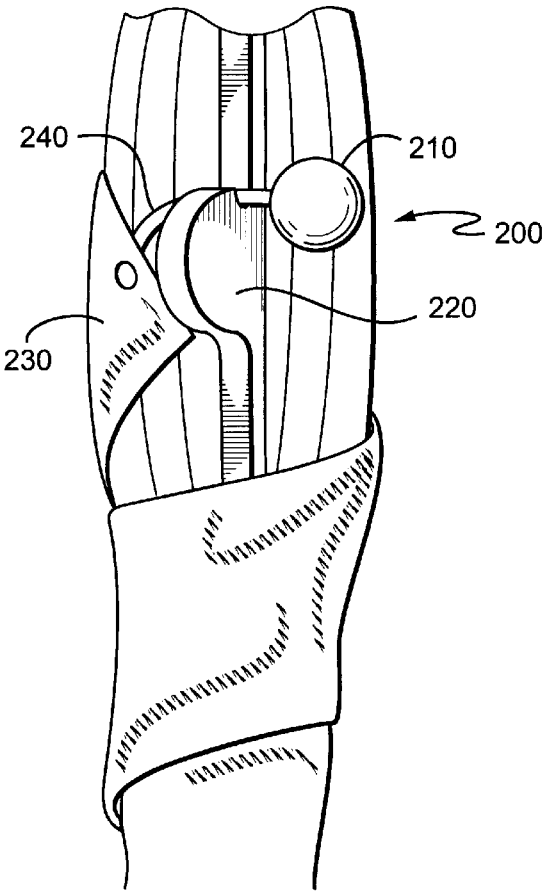
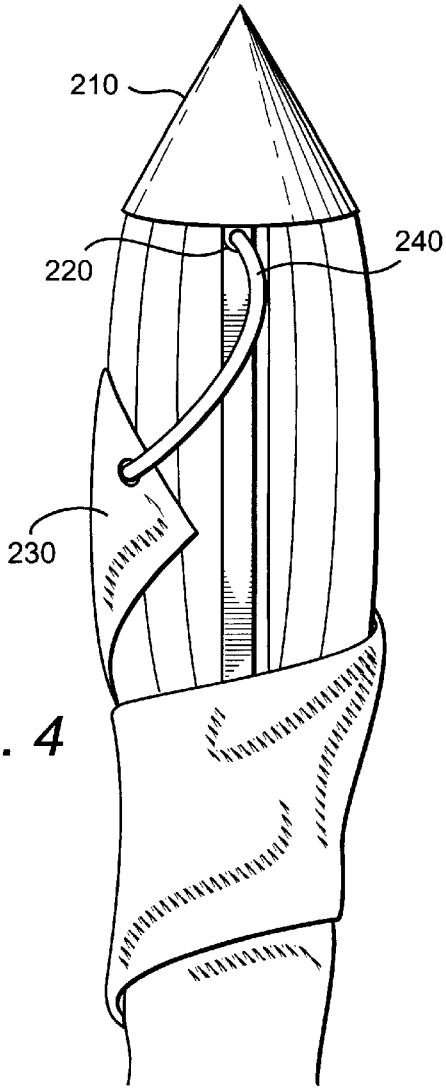
FIG. 4
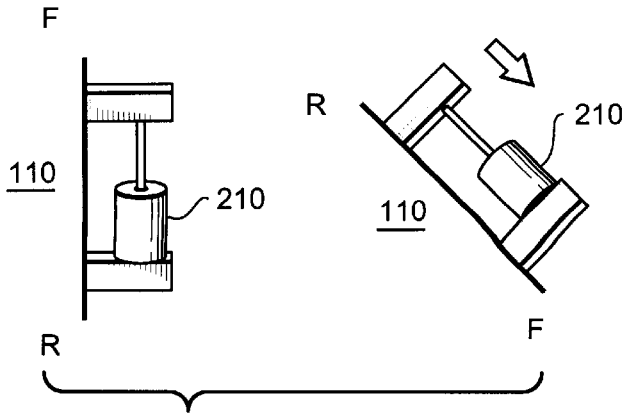
FIG. 6

TOY GLIDER

FIELD OF THE INVENTION

The field of the invention is flying toys.

BACKGROUND OF THE INVENTION

Flying toy gliders is a recreational activity enjoyed by many people. Of particular interest herein are gliders which are catapulted/launched into the air to achieve an initial height, possibly through the use of a slingshot or catapult type mechanism, and subsequently glide back down to the ground. The enjoyment associated with launched gliders is often increased by increasing the initial height achieved, and thereby increasing the length of time the glider remains in flight.

An increased initial height can be achieved by reducing the amount of drag exerted on the glider during the period of time between the launching of the glider and the glider achieving its initial height. One method of reducing drag is to utilize a glider having wings which have a reduced drag configuration for launching (hereinafter "launch configuration"), and another configuration suitable for gliding (hereinafter "glide configuration").

One problem associated with the use of folding or otherwise re-configurable wings (hereinafter simply "folding wings") is how to reliably transition the wings from the launch configuration to the glide configuration at an appropriate time. A common mechanism involves biasing the wings towards a glide configuration, folding the wings back against the bias for launching, launching the glider, and allowing the drag forces exerted on the glider to maintain the wings in the launch configuration until the glider slows sufficiently for the bias to cause the wings to transition to the glide configuration (See U.S. Pat. Nos. 4,915,664, Issued Apr. 10, 1990 to Bakker; 4,863,413, Issued Sep. 5, 1989 to Schwarts; 4,863,412, Issued Sep. 5, 1989 to Mihalinec; 4,836,817, Issued Jun. 6, 1989 to Corbin, and 5,423,706, Issued Jun. 13, 1995 to Chase). The use of air pressure to maintain wing position has a serious drawback, in that the benefit of the reduced drag is lost as the wings begin to unfold. The bias on the wings starts to force the wings to transition to a glide configuration before the glider achieves its initial height with the drag forces on the glider increasing during the transition process.

Another method which has been used involves including a radio controlled motor in the glider, with the wings being deployed after receipt of a radio signal (see U.S. Pat. No. 4,759,736, Issued Jul. 26, 1988 to Carlson). The method is not entirely satisfactory as it greatly increases the cost, complexity, and weight of the glider, and requires operator involvement in the reconfiguration process.

Thus, there is a continuing need to improve release mechanisms for launched, toy gliders.

SUMMARY OF THE INVENTION

The present invention is directed to improved toy gliders having folding wings and incorporating improved release mechanisms which increase the initial height achievable by the glider by preventing early transition of the folding wings from a launch configuration to a glide configuration.

In a particular embodiment, a long ribbon-like tail is wrapped around the glider to prevent biased wings from transitioning from a launch to a glide configuration. After launch a weight is released from a support, perhaps due to a change in attitude of the glider, and the released weight contributes to unwrapping the tail. Once the tail is unwrapped, the wings transition from their launch to their glide configuration.

Various objects, features, aspects and advantages of the present invention will become more apparent from the following detailed description of preferred embodiments of the invention, along with the accompanying drawings in which like numerals represent like components.

BRIEF DESCRIPTION OF THE DRAWINGS

FIG. 1 is a perspective view of a first glider embodying the invention in a launch configuration.

FIG. 2 is a perspective view of the embodiment of FIG. 1 in a glide configuration.

FIG. 3 is a detail view of the release mechanism of the embodiment of FIG. 1.

FIG. 4 is a detail view of a second release mechanism.

FIG. 5 is a detail view of a third release mechanism.

FIG. 6 is a detail view of a fourth release mechanism.

DETAILED DESCRIPTION

Referring first to FIGS. 1, 2, and 3, a toy glider 100 is shown having a body 110, wings 120, and a release mechanism 200. The release mechanism 200 includes a weight 210, a weight support 220, a long ribbon-like tail 230, and a weight-to-tail connector 240. As used herein, the term "toy glider" is used to indicate that the glider can be manufactured and sold for a profit with a sales price of less than $50.00. The term glider is intended to include any device, with or without folded wings, which is positioned at a suitable height above ground and allowed to descend to the ground regardless of whether the descent is accomplished by gliding, flying, spinning, floating, or any other means.

The release mechanism 200 differs from prior art mechanisms. Two particular differences are the incorporation of a triggering mass (weight 210), and a wing retaining member (tail 230) wrapped around the wings to prevent the wings from transitioning from a launch configuration to a glide configuration. The use of a triggering mass to activate the release mechanism allows the wings to be released whenever the triggering mass undergoes a triggering movement (a movement of the triggering mass which activates the release mechanism). The use of a wing retaining member wrapped around the wings prevents the wings from beginning to transition, and thus perhaps prevents increased drag, before the wing retaining member is unwrapped.

The use of a triggering mass allows for glider designs in which triggering movements result due to any of a number of forces acting upon the glider, such as drag and gravity. Different embodiments of the claimed invention may incorporate triggering masses which undergo triggering movement after the occurrence of one or more events (hereinafter "triggering event(s)"). One example of a possible triggering event is the passage of sufficient time for cumulative forces acting on the glider to cause the triggering mass to undergo a triggering movement. Another example is the glider exceeding a particular height. Yet another example is the glider achieving its initial height and beginning a downward path. The triggering even of the last example is of particular interest because triggering on such an event may allow the glider to achieve a maximum initial height without knowing what that height is or how long it will take to achieve it. The embodiments of FIGS. 1–6 incorporate triggering masses which may undergo triggering movements after or during the occurrence of such a triggering event (which may be referred to as a "change in attitude").

Glider 100 can be described as having a plurality of attitudes. Although numerous methods for describing the current attitude of an aircraft, including, among others, orientation of the body relative to the direction of travel and orientation relative to the horizon, attitude herein will be specified by simply specifying an angle of elevation. The angle of elevation will range from −90 degrees to +90 degrees where an angle of elevation of +90 degrees indicates that the glider is pointing straight up, an angle of elevation of −90 degrees indicates that the glider is straight down, and an angle elevation of 0 degrees indicates that the glider is level and that both the from and rear portions of the glider are at the same height. Thus a positive angle of elevation (sometimes hereinafter simply "a positive attitude") indicates that the front of the glider is higher than the rear of the glider and a negative elevation (sometimes hereinafter simple "a negative attitude") indicates that the front of the glider is lower than the rear of the glider.

As the glider achieves its initial height after launching, the attitude of the glider will change from positive to negative. Upon achieving a negative attitude, weight 210 is no longer supported by weight support 220. Without the support of weight support 220, a combination of forces will act on the weight and the rest of the glider causing the weight to unwrap the tail 230 from around body 110 and wings 120. Wings 120 are biased to transition from a folded, launch configuration, to an unfolded glide configuration such that the unwrapping of the tail allows the bias of the wings to transition the wings from the launch configuration to the glide configuration. Wrapping the tail around the wings is likely to further reduce the drag on the glider during launch than simply folding the wings. Moreover, preventing the wings from even partially unfolding prior to the glider achieving its initial height is likely to also reduce the drag on the glider during launch.

The body 110 and wings 120 may be made from any suitable material(s) and have any suitable size and dimensions wherein suitability is defined as allowing a glider having a body and wings made from the material(s) in questions, and/or the size and dimensions in questions, to be positioned at a height and to descend to the ground. It is preferred that a thin material such as a plastic or nylon be used. It is contemplated that the size and dimensions of the body and wings may result in, among others, an appearance similar to that of traditional aircraft such as an airplane, hang glider, or even a traditional glider sized and dimensioned to carry people, or of other flying objects or animals such a kite or a bird. Wings, as used herein, is not intended to be limiting as to any particular form but instead encompasses any mechanism proving a lifting surface or otherwise preventing the glider from falling in the same manner as it would if were comprised of a set of unconnected parts. It is anticipated that known methods for reinforcing and building gliders may also be utilized to provide or enhance features of claimed subject matter.

In a preferred embodiment the wings of the glider will be reconfigurable between a folded up launch configuration and an extended glide configuration. Just as the size and shape of the wing may vary, the method utilized to achieve either configuration may vary, and may include, among others, folding the wings back against the body, rotating and folding the wings back against the body, retracting the wings within the body, and wrapping the wings around the body in the same manner as an umbrella is wrapped around its handle.

It is preferred that the wings be biased to transition from the launch configuration to the glide configuration. Any biasing method may be used and may include, among others, the use of springs, wires, plastics, or elastic bands. Other, less preferred embodiments, may not have biased wings, may bias the wings to transition from the glide to the launch configuration, or may bias the wings to transition between other configurations.

During launch it is preferred that the glider wings be and remain in the launch configuration. Various mechanisms may be utilized to insure that the wings do not transition until the release mechanism is activated and may utilize tubes, hooks, rings, shrouds, wrappings or other mechanisms or combinations thereof. The embodiment of FIG. 1 utilizes the long tail/wing retaining member 230 as a wrapping to retain the wings in the launch configuration. This mechanism may result in reduced drag and increased structural support on the glider during launch. Embodiments utilizing tails are contemplated wherein the tail may be rigid, semi-rigid, or non-rigid. The material used to make the tail might be a nylon, plastic, or other material or combination thereof. The tail may be an extension of the body or be a separate piece fastened to the body, the wings, or some other portion of the glider. Long, as used herein, is any length which allows the tail to be wrapped around the glider to prevent the biased wings from transitioning. Although not limited to any specific lengths, various embodiments may utilize tails having, among other, a length equal to the distance between a tail mounting point and the weight support, equal to at least the length of the body of the glider, or equal to the length required to wrap the tail at least once completely around the body and wings and to allow the weight support to support the weight.

In other embodiments the wing retaining member may be a shroud, sleeve, or sheath which slides at least partially over the body and wings while the wings are in the launch configuration and slides off of the wings to allow the wings to transition to the glide configuration. The wing retaining member may be made from any material or combination of materials as long as it is configurable in both a wrapped configuration in which the wings are prevented from transitioning from the launch configuration to the glide configuration, and an unwrapped configuration in which the retaining member does not prevent the wings from transitioning from the launch configuration to the glide configuration. Variations of the term "wrapped" are used loosely herein to describe a situation where the retaining member prevents the transitioning of the wings from the launch to the glide configuration. Thus, if a cylindrical sleeve were used where the sleeve slides over the body and wings to prevent the wings from transitioning, the sleeve, when slid at least partially over the body and wings, would be said to be "wrapped" or "in a wrapped configuration". When the wing retaining member is no longer preventing the wing from transitioning from the launch configuration to the glider configuration, the wing may be said to be "free to transition" even though the transition may not occur until after the passage of time or some other event, possibly unrelated tot he retaining member, has occurred.

When it is desired that a change in attitude trigger wing deployment, any release mechanism which is automatically activated (hereinafter sometimes simply "activated") due to a change in attitude of the glider, and when activated causes or allows the glider to transition from a launch configuration to a glide configuration may be utilized. The term "automatically activated" or simply "activated" as used herein indicates, among other things, that no human intervention is required between the time that the glider attitude changes and the time that the glider begins to transition from the launch configuration to the glide configuration. Referring to FIG. 3, a preferred embodiment is simply a weight 210, resting on support 220, and connected to tail 230 by connector 240. In another embodiment, as shown in FIG. 4, the weight support may be the nose of the glider and the weight may be sized and dimensioned to fit onto the nose of the glider during launch, and to slide off the nose as the glider transitions from a positive to a negative attitude. Placing the weight on the nose of the glider may provide the benefit of promoting a quicker change in attitude by the glider once it reaches its initial height. Yet another embodiment, as shown in FIG. 5, might have a weight 210 and rod 250 radially attached to disk 260 which is rotatably mounted to the glider by support 270. Changes in attitude of the glider would result in rotation of the notched disk 260 with the repositioning of the notch activating the release mechanism. Yet another embodiments may include having a weight slide on a rod positioned parallel to the body of the glider so that changes will trigger the release mechanism by causing the weight to slide along the rod.

In many embodiments, the triggering mass, whether or not a triggering movement is caused by a change in attitude, is separable from the body of the glider. As used herein, "separable from the body" is used to describe the ability of the triggering mass to travel in a path which diverges, at least in part, from that of the body. As an example, in the embodiment of FIG. 1 the weight 210 slides off of its support 220 and away from the body 110 when a positive to negative attitude change occurs. While sliding off of its support and away from the body, the path of the weight and the body diverge (although their paths may converge at a later point in time). Because their paths can diverge, they weight is "separable from the body". The term "separable from the body" as used herein is not intended to cover instances in which the paths of the triggering mass and body diverge due to forces, possibly destructive, which are not normally encountered during glider flight.

Thus, specific embodiments and applications of a toy glider having folding wings and incorporating improved release mechanisms have been disclosed. It should be apparent, however, to those skilled in the art that many more modifications besides those already described are possible without departing from the inventive concepts herein. For example, the embodiments of the release mechanism discussed herein could be replaced by other methods for activating a release mechanism when the glider attitude changes. Similarly, it is possible to replace the wings of the glider with blades, to remove the wings and use the body of the glider as a lifting surface, or to otherwise modify the structure of the glider. The inventive subject matter, therefore, is not to be restricted except in the spirit of the appended claims.

What is claimed is:

1. A toy glider comprising:

a body capable of flight characterized by a plurality of attitudes;

at least one wing having a launch configuration and a glide configuration;

a release mechanism capable of activation wherein transition of the at least one wing between the launch configuration and the glide configuration follows activation of the release mechanism.

a triggering mass coupled to the release mechanism and capable of a triggering movement, wherein the triggering mass is movable in all directions with respect to the release mechanism before the triggering movement, and wherein the triggering movement is a movement of the triggering mass which activates the release mechanism.

2. The toy glider of claim 1 wherein the triggering movement results from an at least partial separation of the triggering mass from the body.

3. The toy glider of claim 2 wherein the separation results from drag forces pulling the body away from the triggering mass.

4. The toy glider of claim 2 wherein the separation results from gravity pulling the triggering mass away from the body.

5. The toy glider of claim 1 wherein a change in attitude comprising a change from a first attitude of the plurality of attitudes to a second attitude of the plurality of attitudes results in the triggering movement of the triggering mass.

6. The glider of claim 5 wherein the first attitude of the plurality of attitudes is a positive attitude and the second attitude of the plurality of attitudes is a negative attitude.

7. The glider of claim 5 further comprising a mass support sized and dimensioned to receive the triggering mass, and positioned to prevent the triggering movement of the triggering mass for at least some of the plurality of attitudes.

8. The glider of claim 6 wherein the at least one wing is biased to transition from the launch configuration to the glide configuration.

9. The glider of claim 7 further comprising a non-elastic ribbon-like tail configured in a wrapped configuration wherein the tail is wrapped around the body and wing while the wing is in the launch configuration, and the tail having an unwrapped configuration wherein the tail is not wrapped around the body and wing, and the wing is free to transition from the launch configuration to the glide configuration.

10. The glider of claim 9 wherein the release mechanism further comprises the non-elastic ribbon-like tail, wherein the triggering mass is coupled to the tail and to the mass support so that a change in attitude which permits the weight to move results in the weight causing the tail to transition from the wrapped configuration to the unwrapped configuration.

11. The glider of claim 1 wherein the release mechanism comprises:

a catch biased to open;

a notched disk having a first position in which the catch prevents the catch bias from opening the catch, and a second position in which the catch allows the catch bias to open the catch;

a rod radially coupled to the disk;

the triggering mass coupled to the rod; and the triggering mass, rod, and disk configured so that changes in glider attitude result in rotation of the disk.

12. A toy glider comprising:

a body capable of flight, and a release mechanism coupled to the body;

at least one wing having a launch configuration and a glide configuration;

a wing retaining member configurable in a wrapped configuration and an unwrapped configuration, the wing retaining member further having a triggering mass that is coupled to the release mechanism;

the wing retaining member, when in the wrapped configuration, substantially prevents the at least one wing from transitioning from the launch configuration to the glide configuration, the wing retaining member, when in the unwrapped configuration, allows the at least one wing to transition from the launch configuration to the glide configuration.

13. The glider of claim 12 wherein the wing retaining member comprises a tail coupled to the body wherein the tail, while in the wrapped configuration, is wrapped at least once around the body and the at least one wing while the at least one wing is in the launch configuration.

14. The glider of claim 13 further comprising a weight coupled to the tail.

15. The glider of claim 14 wherein the weight is separable from the body while the weight is coupled to the tail, and separation of the weight from the body causes or allows the tail to transition from the wrapped to the unwrapped configuration.

16. The glider of claim 14 further comprising a weight support sized and dimensioned to receive the weight, and positioned to prevent at least some movement of the weight.

* * * * *